United States Patent [19]

Michalak

[11] Patent Number: 4,784,074

[45] Date of Patent: Nov. 15, 1988

[54] DUAL WALKWAY - CENTRAL BOAT TRANSOM

[75] Inventor: Jerome M. Michalak, Cocoa Beach, Fla.

[73] Assignee: Ray Industries, Inc., Knoxville, Tenn.

[21] Appl. No.: 68,003

[22] Filed: Jun. 29, 1987

[51] Int. Cl.[4] ..... B63B 1/00

[52] U.S. Cl. ..... 114/57

[58] Field of Search ..... 114/355-358, 114/56, 57; D12/300, 302, 307, 310, 311, 314

[56] References Cited

U.S. PATENT DOCUMENTS

| | | | |
|---|---|---|---|
| D. 153,910 | 5/1949 | Williamson | D71/1 |
| D. 182,228 | 3/1958 | Fennessey | D71/1 |
| D. 184,176 | 12/1958 | Hupp | D71/1 |
| D. 190,065 | 4/1961 | Currie | D71/1 |
| D. 195,156 | 4/1963 | Luger et al. | D71/1 |
| D. 222,510 | 10/1971 | Centaro | D12/06 |
| D. 241,928 | 10/1976 | Peterson | D12/06 |
| D. 243,445 | 2/1977 | Khoury | D12/06 |
| D. 243,854 | 3/1977 | Pelkey | D25/02 |
| D. 253,999 | 1/1980 | Richards et al. | D21/02 |
| D. 276,147 | 10/1984 | Arima | D12/314 |
| D. 287,357 | 12/1986 | Allison | D12/314 |
| 688,672 | 12/1901 | Niemeyer . | |
| 3,105,248 | 10/1963 | Ferrell . | |
| 3,613,137 | 10/1971 | Eccles . | |
| 3,955,229 | 5/1976 | Hanel . | |
| 4,095,301 | 6/1978 | Guillen . | |
| 4,378,747 | 4/1983 | Beatty et al. | 114/56 |

OTHER PUBLICATIONS pp. 9, 15 & 22, 1987 Sea Ray Boats Brochure.

*Primary Examiner*—Sherman D. Basinger
*Assistant Examiner*—Jesûs D. Sotelo
*Attorney, Agent, or Firm*—Malin, Haley & McHale

[57] ABSTRACT

An outboard motor boat having an aft configuration with a new and improved transom configuration that includes a stand alone, upwardly projecting, cantilever shaped central transom portion. The transom configuration also includes a transom mid portion connected to the base of the central transom portion and a lower transom portion connected to the transom mid portion. The central transom portion is positioned centrally between a port side through transom walkway and a starboard side through transom walkway. The port side through transom walkway and the starboard side through transom walkway project aft from the aft deck along either side of the central transom portion to a position at least adjacent a portion of the side of an outboard motor position at the stern of the outboard motor boat.

7 Claims, 3 Drawing Sheets

DUAL WALKWAY - CENTRAL BOAT TRANSOM

BACKGROUND OF THE INVENTION

A new and improved outboard motor boat having an upwardly projecting cantilever shaped central transom portion positioned centrally between a port side through transom walkway and a starboard side through transom walkway on either side of the central transom portion and on the side of the outboard motor position.

In the past outboard motor boats have been constructed with various transom configurations and walkways. The Niemeyer U.S. Pat. No. 688,672 discloses a transom with a platform extending from stern of the boat. The Niemeyer platform extends from the port side of the boat to the starboard side of the boat to aid movement into and from the boat. The platform is below the water line of the boat. Other boats have utilized swimming platform brackets extending for a transom. Swimming platform brackets are shown in the Richards et al. U.S. Pat. No. Des. 253,999. Another type of platform or walkway used in the past over boat transoms is shown in the Parsons' U.S. Pat. No. Des. 267,866. The Parsons' patent is for a trimaran boat having a step down walkway in the aft portion of the boat without an entrance way through the transom to the main aft deck portion. The Hupp U.S. Pat. No. Des. 184,176 and the Hanel U.S. Pat. No. 3,955,229 show rearward extension portions above the rear transom without an entranceway through the transom to the main aft deck portion. A convertible boat with upper portion is shown in the Ferrell U.S. Pat. No. 3,105,248 shows hinged port and starboard gate type portions. The Ferrell boat does not have walkways through the boat transom. The Guillen vessel that is disclosed in U.S. Pat. No. 4,095,301 shows a side walkway for use as working platform in a porpoise evacuation boat.

Many yatchs have had a single walkway through the upper portion of the transom for access onto the aft deck of the yatch. However, such through walkways have heretofore been used only in connection with inboard-powered boats. Walkways through a transom have not been employed with outboard-powered boats because the outboard engine is typically attached by means of a mounting bracket to the transom. As a consequence, the convenience of a walk-through transom has been denied owners of outboard-powered boats. Further, the mechanical components, particularly those associated with the upper "head" of an outboard motor are often difficult to reach or inspect from the cockpit of an outboard-powered boat, as the motor is typically mounted a substantial distance to the rear of the transom. This forces the operator of the boat to lean over the transom in order to inspect or adjust the components of the outboard engine.

SUMMARY OF THE INVENTION

A new and improved aft configuration for a motor boat in the form of a transom. The outboard motor boat has a hull, deck and sides, with the sides connected together at the bow and with the sides connected to the hull. The deck is connected to the sides and to the transom. The transom configuration has an upper transom portion, a transom mid portion and a lower transom portion. The upper transom portion is an upwardly projecting cantilever shaped central transom portion constructed, arranged and positioned centrally between a port side through transom walkway and a starboard side through transom walkway. This upwardly projecting central transom portion has a base permimeter connected to portion of the aft deck and to the top of the transom mid portion. The central transom portion has an upper end or rail, a port walkway side, a starboard walkway side, a stern side forward of the outboard motor position, and a forward side rearward of the aft deck. The port side through transom walkway and the starboard side through transom walkway project aft from the aft deck portion of the deck, on either side of the central transom portion. The walkways extend past the upper central transom portion to a position at least adjacent a portion of the side of the outboard motor position. The transom mid portion, the port side through transom walkway and the starboard side through transom walkway define the outboard motor position.

The transom mid portion and the lower transom portion are connected to and between the sides and to the hull.

The transom configuration includes an outboard motor connecting well means that is connected between the transom mid portion and the central transom portion. The connecting well means allows an outboard motor to be removably connected to the boat. The connecting well means also allows the front and at least a portion of the sides of the outboard motor to be positioned over the outboard motor connecting well means. When the outboard motor propellor is raised out of the water, the outboard motor is tilted over the outboard motor connecting means.

The transom mid portion is constructed in a generally convex shape so that the boat may more easily move in a reverse direction through the water.

The lower transom portion is spaced forward of the transom mid portion. A riser connecting means is connected between an upper perimeter of the lower transom portion and a lower perimeter of the transom mid portion. The riser connecting means allows water moving out from under the hull to rise up higher aft of the lower transom portion, thereby placing the outboard motor propeller deeper within the water after the boat passes over the water.

It is an object of this invention to provide an outboard-powered boat hull which incorporates a walk-through transom and to provide such walkways around an upper central transom to permit the operator of the boat to stand closer to the engine to inspect or adjust it, without having to lean over the transom.

Accordingly, the principal object of the present invention is to provide an outboard-powered boat hull with dual through transom walkways in the transom configuration.

Yet another object of the invention is to provide such a hull in which walk-through portions are provided on either side of an outboard engine mounted on the transom.

Yet still another object of the invention is to provide such a "split-entry" transom in which the central transom projects upward supported at the base with walkways extending substantially rearwardly of the upper central transom to provide convenient access to upper portions of an outboard engine mounted on the rear of the transom.

An additional object is to provide a central transom between walkways in an outboard motor boat to protect the sailor or fisherman from contact with the outboard motor and to provide a central transom rail forward of the outboard motor.

These and other, further and more specific objects and advantages of the invention will be apparent to those skilled in the art from the following detailed description thereof, taken in conjunction with the drawings.

DESCRIPTION OF THE PREFERRED EMBODIMENT

Figure 1:
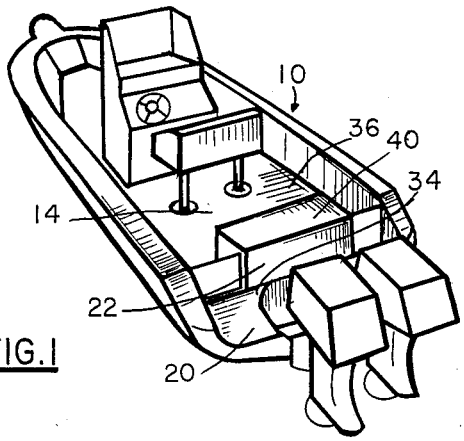
FIG. 1 is a rear perspective view from the upper left of a typical boat constructed in accordance with the principles of the present invention, with the outboard engine mounted centrally thereon.
Figure 2:
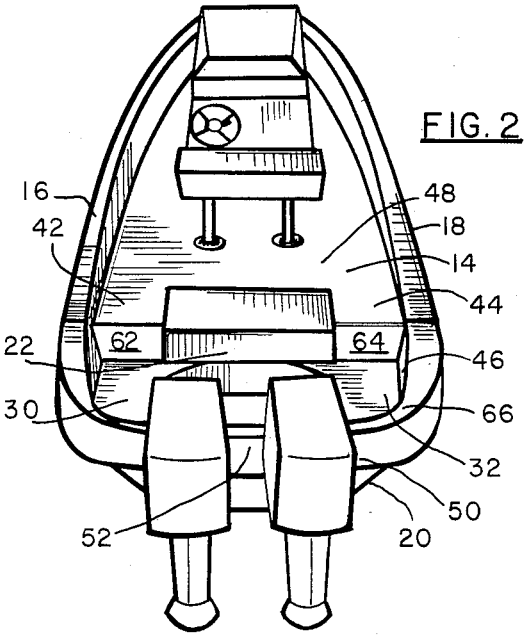
FIG. 2 is a rear perspective view from the rear of the transom portion of the boat of FIG. 1, showing a pair of outboard engines mounted on the transom.
Figure 3:
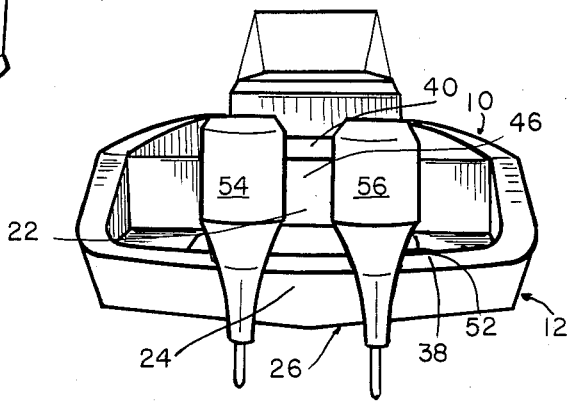
FIG. 3 is a rear view of the boat shown in FIG. 1.
Figure 4:
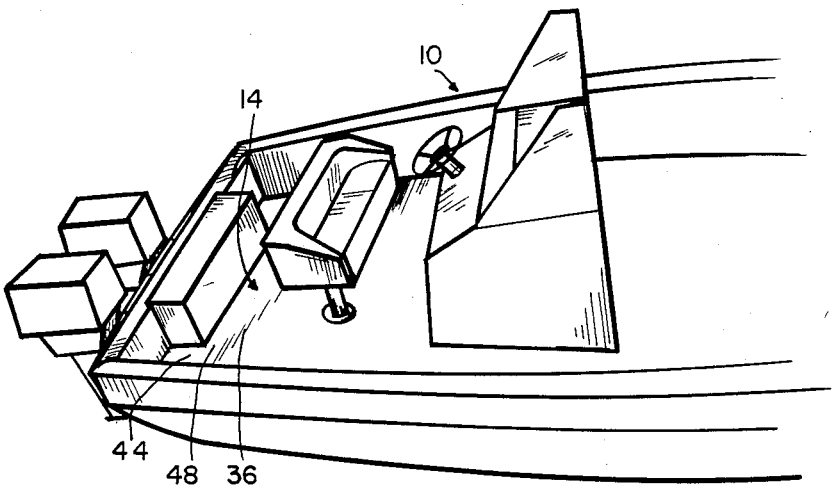
FIG. 4 is a forward perspective view of the transom from the upper right.
Figure 5:
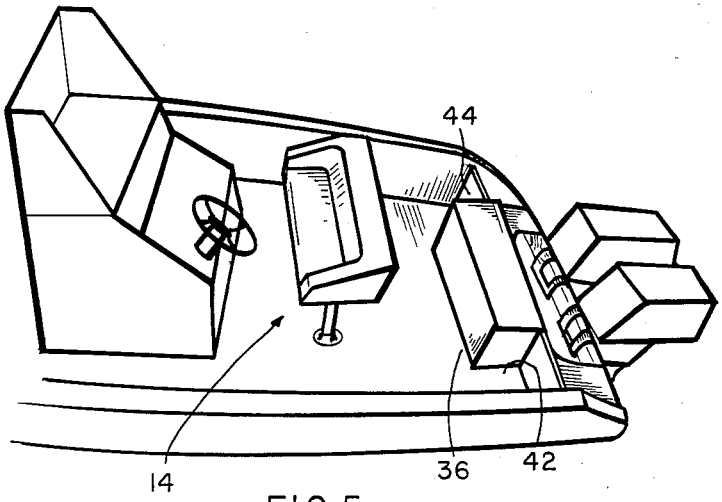
FIG. 5 is a forward perspective view of the transom from the upper left.
Figure 6:
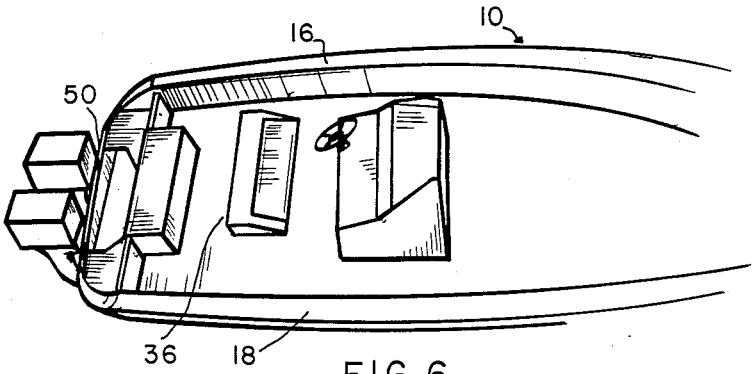
FIG. 6 is a top view.

This invention is to a new and improved aft configuration for an outboard motor boat 10 as shown in FIGS. 1 through 6. The outboard motor boat 10 has a hull 12, deck 14 and sides 16 and 18. The sides of the boat 10 are connected together and connected to the hull 12. The deck is connected to the sides of the outboard motor boat. The aft configuration is shown in FIGS. 1, 2, 3 and 7 and includes a transom configuration 20 with an upper transom portion 22, a transom mid portion 24 and a lower transom portion 26. The upper transom portion 22 shown in FIGS. 1 and 2 is an upper cantilever shaped central transom portion 22 constructed, arranged and positioned centrally between a port side through transom walkway 30 and a starboard side through transom walkway 32 shown in FIG. 2. This upper central transom portion 22 projects upward unsupported above a base perimeter 34 as illustrated in FIG. 1. The base perimeter 34 connected to an aft deck portion 36 of the deck 14 and to the top 38 of the transom mid portion 24 as shown in FIG. 3. The upper central transom portion 22 has an upper end or rail 40, with a port walkway side 42, a starboard walkway side 44, an aft side 46 forward of the outboard motor position 50, and a forward side 48 rearward of the deck 14 as shown in FIGS. 2, 4 and 5. The port side through transom walkway 30 and the starboard side through transom walkway 32 project aft from the aft deck portion as shown in FIGS. 1 and 2. The walkways extend past the upper central transom portion 22 to a position at least adjacent a portion of a side of the outboard motor position 50 as shown in FIG. 6. When the motors are tilted forward, the motors are positioned over a portion of the transom. The transom mid portion 16, the port side through transom walkway 30 and the starboard side through transom walkway 32 define the outboard motor position 50.

An outboard motor connecting well means 52 shown in FIGS. 2 and 3 is connected between the transom mid portion 24 and the upper central transom portion 22. The connecting well means 52 allows an outboard motor or motors 54 and 56 to be removably connected to the boat and allows the motor or motors to be positioned with the front and at least a portion of the sides of an outboard motor or motors over the outboard motor connecting well means 50.

Figure 7:
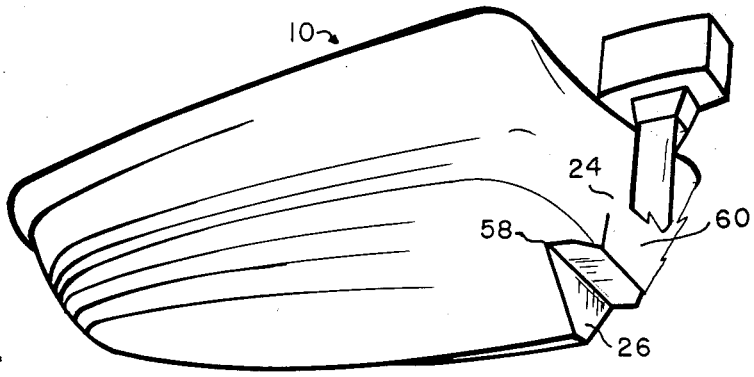
FIG. 7 is a bottom perspective view from the lower right showing the transom mid portion and the lower transom portion.
Figure 8:
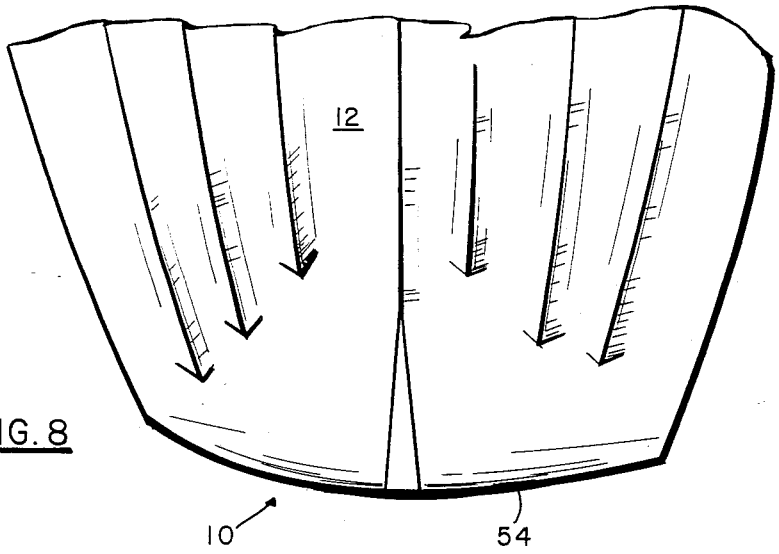
FIG. 8 is a bottom view of the boat.

The transom mid portion 24 and the lower transom portion 26 are connected to and between the sides 16 and 18 and to the hull 12. The transom mid portion 24 is constructed in a generally convex shape at 54 shown in FIG. 8 so that the boat 10 may easily move in a reverse direction through the water. The lower transom portion 26 shown in FIG. 7 is spaced forward of the transom mid portion 24. A riser connecting means 56 is connected between an upper perimeter 58 of the lower transom portion 56 and a lower perimeter 60 of the transom mid portion 24. The riser connecting means 50 allows water moving under the hull to rise aft of the lower transom portion 26 to place the outboard motor propellor in deeper water.

Swing doors 62 and 64 may be connected across the walkways. A short step down configuration 66 may be incorporated in the walkways. The ladder 68 may be recessed into the walkway.

Figure 9:
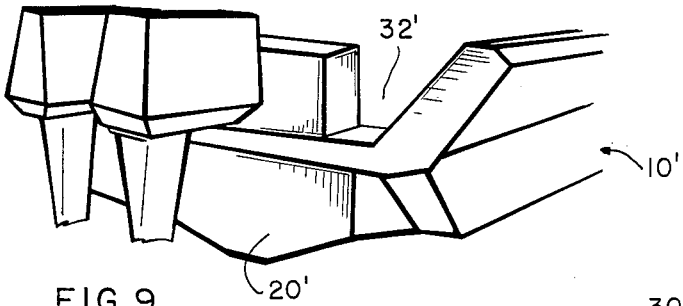
FIGS. 9 and 10 are rear views of another transom configuration of the invention.
Figure 10:
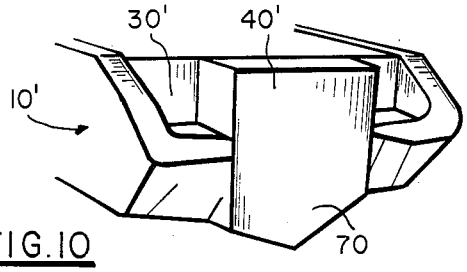

FIGS. 9 and 10 show another embodiment of an outboard motor boat 10' with port side through walkway 30' and a starboard side through walkway 32'. Transom configuration 20' is generally flat from the rail 40' to the bottom of the transom 70.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An outboard motor boat having a hull, deck and sides with said sides connected together and with said sides connected to said hull and with said deck connected to said sides and having an aft configuration comprising:

a transom configuration including:

an upwardly projecting central transom portion connected, arranged and positioned centrally between a port side through transom walkway and a starboard side through transom walkway and between said sides, said upwardly projecting central transom portion projecting upward and solely supported at or below a base perimeter, said base perimeter connected to an aft deck portion of said deck, said upwardly projecting central transom portion projecting approximately the height of said sides, said upwardly projecting central transom portion having an upper end, a port walkway side, a starboard walkway side, an aft side and a forward side, said port side through transom walkway and said starboard side through transom walkway projecting aft from said aft deck portion, past said upwardly projecting central transom portion, to a position at least adjacent a portion of a side of an outboard motor position, a transom mid portion connected to and between said sides and to said hull;

said transom mid portion, said port side through transom walkway and said starboard side through transom walkway defining said outboard motor position.

2. An outboard motor boat as set forth in claim 1 including:

an outboard motor connecting well means connected between said transom mid portion and said central transom portion, said connecting well means being for removably connecting an outboard motor to said boat, said connecting well means arranged and positioned for allowing the outboard motor to tilt over said outboard motor connecting well means and for allowing the positioning of the front end and at least a portion of the side of the outboard motor above said outboard motor connecting well means.

3. An outboard motor boat having a hull, deck and sides with said sides connected together and with said sides connected to said hull and with said deck connected to said sides and having an aft configuration comprising:

a transom configuration including:

an upwardly projecting central transom portion connected, arranged and positioned centrally between a port side through transom walkway and a starboard side through transom walkway and between said sides, said upwardly projecting central transom portion projecting upward and solely supported at or below a base perimeter, said base perimeter connected to an aft deck portion of said deck, said upwardly projecting central transom portion projecting approximately to the height of said sides, said upwardly projecting central transom portion having an upper end, a port walkway side, a starboard walkway side, an aft side and a forward side, said port side through transom walkway and said starboard side through transom walkway projecting aft from said aft deck portion, past said upwardly projecting central transom portion, to a position at least adjacent a portion of a side of an outboard motor position, a transom mid portion connected to and between said sides and to said hull;

said transom mid portion, said port side through transom walkway and said starboard side through transom walkway defining said outboard motor position;

an outboard motor connecting well means connected between said transom mid portion and said upwardly projecting central transom portion;

said connecting well means being for removably connecting an outboard motor to said boat, said connecting well means arranged and positioned for allowing the outboard motor to tilt over said outboard motor connecting well means and for allowing the positioning of the front end and at least a portion of the side of the outboard motor above said outboard motor connecting well means.

4. An outboard motor boat as set forth in claim 3 including:

a lower transom portion connected to and between said sides and between said transom mid-portion and said hull;

said lower transom portion spaced forward of said transom mid portion;

a riser connecting means connected between an upper perimeter of said lower transom portion and a lower perimeter of said transom mid portion;

said riser connecting means for allowing water over which said boat passes to rise just aft of said lower transom portion to place an outboard motor propeller in deeper water behind said boat.

5. An outboard motor boat as set forth in claim 4 including:

a swing door connected to said boat positioned and arranged in one position to span across said pot side through transom walkway and said starboard side through transom walkway.

6. An outboard motor boat as set forth in claim 4 wherein:

said upwardly projecting central transom portion contains a well with an opening and a well cover.

7. An outboard motor boat having a hull, deck and sides with said sides connected together and with said sides connected to said hull and with said deck connected to said sides and having an aft configuration comprising:

a transom configuration including:

an upwardly projecting central transom portion connected, arranged and positioned centrally between a port side through transom walkway and a starboard side through transom walkway and between said sides, said upwardly projecting central transom portion projecting upward and solely supported at or below a base perimeter, said base perimeter connected to an aft deck portion of said deck, said upwardly projecting central transom portion having an upper end, a port walkway side, a starboard walkway side, an aft side and a forward side, said port side through transom walkway and said starboard side through transom walkway projecting aft from said aft deck portion, past said upwardly projecting central transom portion, to a position at least adjacent a portion of a side of an outboard motor position, a transom mid portion connected to and between said sides and to said hull;

said transom mid portion, said port side through transom walkway and said starboard side through transom walkway defining said outboard motor position and each having an aft perimeter, said perimeters of said port side through transom walkway and said starboard side through transom walkway positioned further aft than said perimeter of said transom mid-portion.

* * * * *